United States Patent [19]

Stokoe et al.

[11] Patent Number: 4,918,273

[45] Date of Patent: Apr. 17, 1990

[54] CONTACT FOR DUAL IN-LINE PACKAGE PACKAGED SLIDE SWITCH

[75] Inventors: Philip T. Stokoe, N. Attleboro, Mass.; Dennis R. Boulais, Danielson, Conn.

[73] Assignee: Alco Electronic Products, Inc., North Andover, Mass.

[21] Appl. No.: 344,766

[22] Filed: Apr. 28, 1989

Related U.S. Application Data

[60] Continuation of Ser. No. 219,041, Jul. 14, 1988, abandoned, which is a continuation of Ser. No. 948,310, Dec. 31, 1986, abandoned, which is a division of Ser. No. 817,006, Jan. 8, 1986, Pat. No. 4,687,887.

[51] Int. Cl.[4] ..... H01H 1/42

[52] U.S. Cl. ..... 200/550; 200/254

[58] Field of Search ..... 200/547, 548, 549, 550, 200/282, 254, 275, 253, 16 D, 16 F, 291

[56] References Cited

U.S. PATENT DOCUMENTS

| | | | |
|---|---|---|---|
| 2,691,702 | 10/1954 | Allison | 200/282 |
| 4,075,442 | 2/1978 | Fukuda et al. | 200/291 X |
| 4,122,317 | 10/1978 | Shimamune et al. | 200/16 F |
| 4,628,166 | 12/1986 | Bingo et al. | 200/16 D |

FOREIGN PATENT DOCUMENTS

| | | | |
|---|---|---|---|
| 1951809 | 8/1970 | Fed. Rep. of Germany | 200/16 D |
| 2110473 | 6/1983 | United Kingdom | 200/16 F |

*Primary Examiner*—Renee S. Luebke

*Attorney, Agent, or Firm*—Pearson & Pearson

[57] ABSTRACT

An inverted U-shaped contact for the slider of a slide switch having a longitudinal axis comprises two pairs of teeth connected longitudinally by a transversely generally semicircular elongated member, each tooth extending downward from the elongated member in a curved convex clasping shape. The opposed convex surfaces of each pair face the other in clasping configuration.

2 Claims, 3 Drawing Sheets

CONTACT FOR DUAL IN-LINE PACKAGE PACKAGED SLIDE SWITCH

This is a continuation of our application Ser. No. 291,041, filed July 14, 1988, now abandoned, which was a continuation of our application Ser. No. 948,310, now abandoned filed Dec. 31, 1986, which was a Divisional application of Ser. No. 817,006, filed Jan. 8, 1986, now U.S. Pat. No. 4,687,887.

FIELD OF THE INVENTION

The invention relates to miniature slide switches of a DIP configuration.

BACKGROUND OF THE INVENTION

The DIP configuration is prevalent in many electronic applications and slide switches of this configuration are known. For example, U.S. Pat. No. 4,075,442 issued Feb. 21, 1978 to Fukuda, et al for Miniature Slide Switch Assembly Having Flexible Detent on Movable Actuator or Fixed Housing, discloses a slide switch having a base member in which a slide member of the switch reciprocates. The base is furnished with recesses in above on the surface of the base member and a matching projection on the slide. A detent action then takes place between the projection and the semicircular recesses in operation to fix the position of the slide in accordance with the desired switch connections. The recesses are off center and are located to the side of the base.

Other patents relating to DIP switches are, for example, U.S. Pat. No. 4,119,823 to Matsueda, et al, Oct. 10, 1978 for an Electrical Switch which shows individual switch settings for individual pairs of terminals. U.S. Pat. No. 4,168,404 to Lockard Sept. 18, 1979 for Impedance Programming DIP Switch Assembly also allows individual switching of pairs of terminals in a DIP switching arrangement. U.S. Pat. No. 4,332,987 to Hoffman for a DIP Switch shows a slide body means in a DIP switch which is receivable in and movable along a channel. U.S. Pat. No. 4,352,966 to English, et al, Oct. 5, 1982 for a Slide Switch discloses a base with a bearing surface. A slider has switch arms which are deformably biased freely over confronting cam surface of contacting projections extending from a housing. U.S. Pat. No. 4,376,234 to Liagaud, Mar. 8, 1983 for a DIP Switch shows a base, pairs of legs from the base, and slide contacts for each pair of legs.

SUMMARY OF THE INVENTION

According to the invention, an inverted U-shaped contact for the slider of a switch has a longitudinal axis and comprises two pairs of teeth connected longitudinally by a generally transversely semicircular elongated member. Each tooth of each member extends downwardly from the elongated member in an S-shape having an S-shape surface of each pair facing the like surface of the other tooth of the same pair in a spaced, clasping configuration, and the contact having longitudinal ends beyond the semicircular member, the longitudinal ends havinga generally square configuration at each opposite end of the contact.

BRIEF DESCRIPTION OF THE DRAWINGS

The various objects, advantages, and novel features of the invention will be more fully understood from the following detailed description of an embodiment of the invention when read in connection with the accompanying drawing in which like reference numerals refer to like parts, and in which.

DESCRIPTION OF A PREFERRED EMBODIMENT

Figure 1:
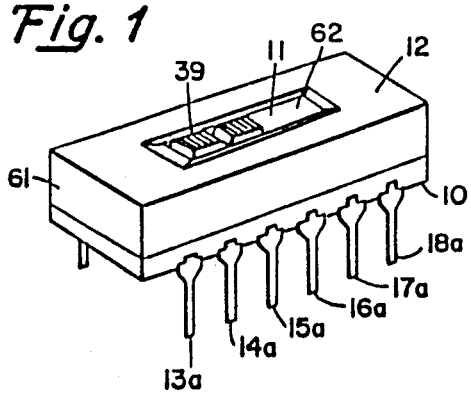
FIG. 1 is a perspective view of an embodiment of the invention.

Referring to FIG. 1, a slide switch embodying the invention comprises a base 10, a slider 11, and a cover 12. Terminals 13*a* through 18*a* are paired respectively with terminals 13*b* through 18*b*, and extend downwardly from the base 10 in a dual in-line configuration (only one "a" contact of each pair is visible in FIG. 1.

Figure 2:
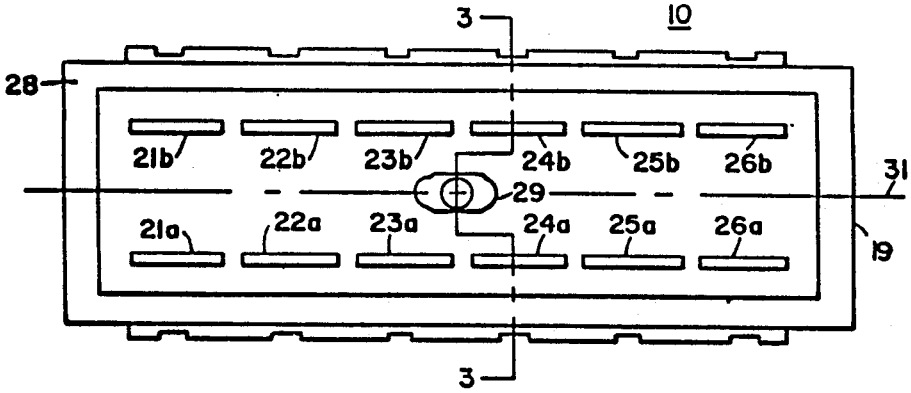
FIG. 2 is a top view of the embodiment of FIG. 1 with the cover and slider removed, showing the base.
Figure 3:
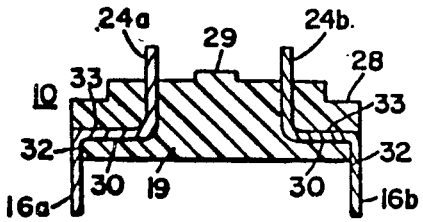
FIG. 3 is a sectional view of the base of FIG. 2 taken along the lines 3—3 of FIG. 2.
Figure 4:
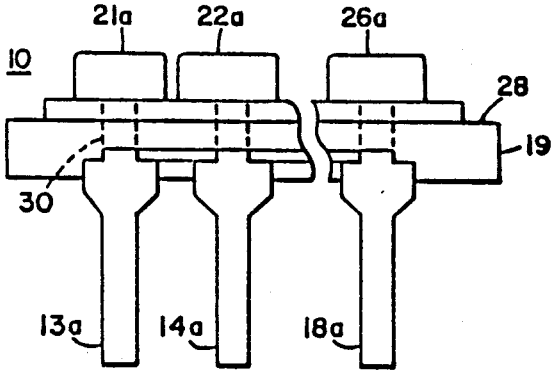
FIG. 4 is a partial side view of the base of FIG. 2.

Referring to FIGS. 2, 4, and 4, each terminal such as 16*a*, 16*b* extend through a base floor 19 of the base 10 and then upwards from the upper surface of base floor 19 to form respectively contact pins 21*a* through 26*a* which are paired respectively with contact pins 21*b* through 26*b* (see FIG. 2). A peripheral ledge 28 (FIGS. 2, 3, and 4) surround the upper part of base floor 19. A detent 29 is raised on the central upper surface of base floor 19 symmetrically along a median longitudinal line 31. The detent 29 which may be an embossment, is also symmetrical with respect to a transverse central line (not shown). A continuous connection interconnects respective contacts 21*a*–26*a* and 21*b*–26*b* respectively through internal passageways 30, with respective contacts 13*a*–16*a*, and 13*b*–16*b*. Vertical grooves 32 along the side of the base floor 19 permit the bending is closely to the base member of the contacts as 16*a* of FIG. 3 as they emerge from the base floor, 19, permitting the intermediate part of terminals 33 to lay flat without obtruding from the base member horizontally. The contact pins 21*a* through 26*a*, and 21*b* through 26*b*, all extend vertically to the same height above the base floor 19.

Referring to FIGS. 5 through 9, the slider 11 comprises a slider element 35 having a bottom 34, and a generally rectangular bore 38 in the bottom 34 of slider element 35, which surrounds a pair of detent receiving recesses 36 and 37. Each recess 36, 37 is complementary in form to the detent 29 on the base 10. The base member has an upwardly extending handle or means of movement 39. Apertures 41, 42 are formed in the slider element 35, one on each side of the longitudinal axis of symmetry and allow a punch to pass through and stamp out the connection link. In rectangular apertures 44, 45, 46, and 47 (44 and 45 being on one side of the axis 31 in FIGS. 5 and 6, and 46 and 47 being on the other side) are downwardly extending contacts 48 through 51 respectively.

Figure 5:
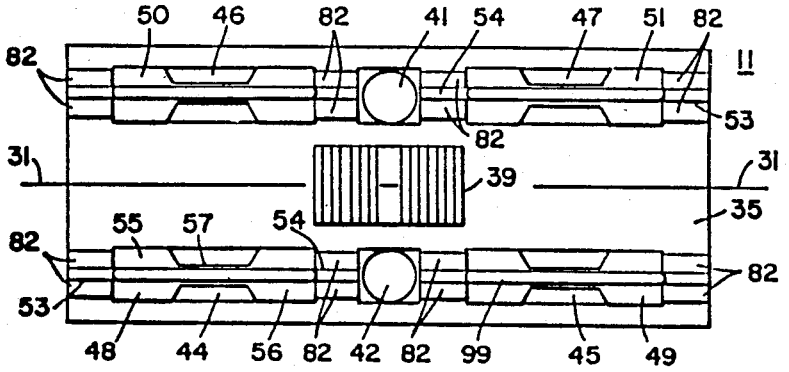
FIG. 5 is a top view of the slider or FIG. 1, with the top removed.
Figure 6:
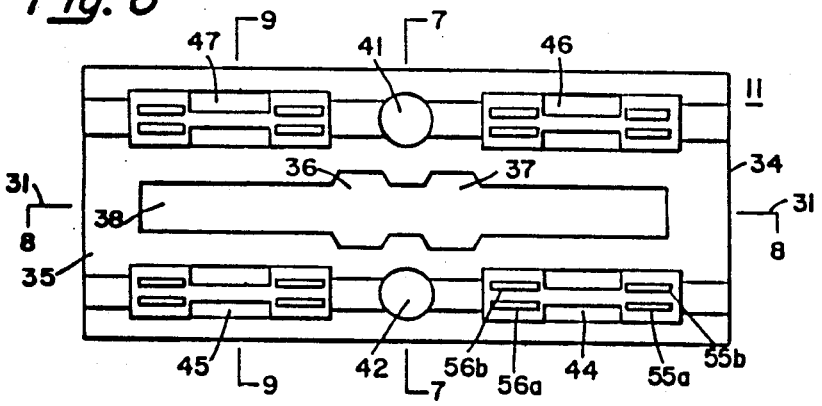
FIG. 6 is a bottom view of the slider of FIG. 5.

Only one downwardly extending contact need be described as the others are similar and arranged in their respective apertures in a similar manner, symmetrically longitudinally and transversely. In FIG. 5, contact 48 is a single piece of metal having two horizontally longitudinal extensions 53, 54 and secured in the top of the slider element by deformable pads 82. Two winglike portions 55,56 of contact 48, adjoin the extensions 53 and 54 respectively, and these winglike portions in turn are connected to the top of a bridging portion 57. The winglike portions 55 and 56 at their sides are bent downwards at the margins of the rectangular aperture 44. Thus, in FIG. 6 the winglike portion 55 finally terminates in a pair of teeth contacts 55*a* and 55*b*, and the winglike portion 56 finally terminates in a pair of teeth contacts 56*a* and 56*b*.

Figure 7:
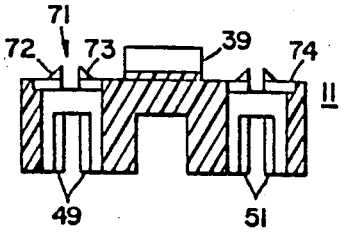
FIG. 7 is a sectional view taken along the lines 7—7 of FIG. 6.
Figure 8:
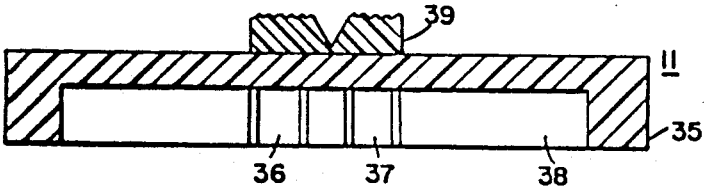
FIG. 8 is a sectional view along the lines 8—8 of FIG. 6.
Figure 10:
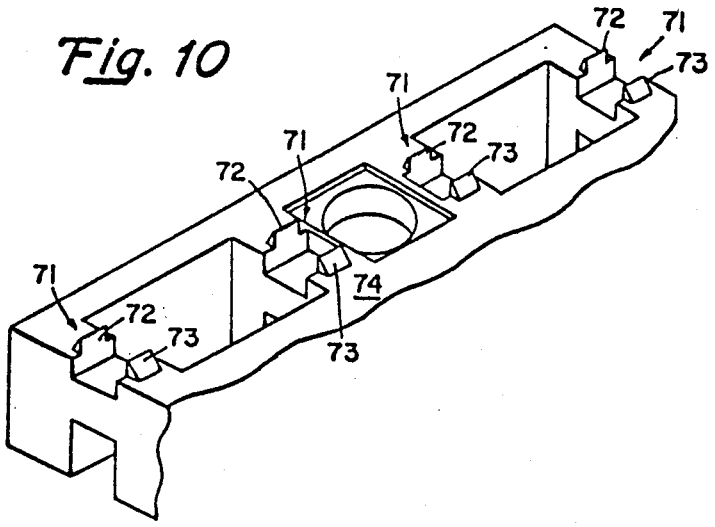
FIG. 10 is an enlarged partial side perspective view showing the deformable hold down tabs.

FIGS. 7 and 10 also show a pair 71 of deformable hold down tabs 72 and 73 on the surface 74 of the slider 35 which are deformed by ultrasonic thermal displacement into pads 82 to hold the contacts in the recesses so that there is no pitch or movement of the contact which is independently suspended and captured in the slider recess and slot. As known, ultrasonic thermal displacement procedures deform materials, such as hold-down tab 72 and 73, to form the pads 82 shown in FIG. 11 and to fill any voids that exist below the pads. Thus, the material in the hold down pads 72 and 73 deforms into the flattened pads 82 shown in FIG. 11 and fills the recesses 105 and 106 shown in FIG. 12.

The cover 12 comprises an inverted box-like portion 61, open at the bottom which fits down over the assembly of slider 11 and base 10, so that the bottom margin of inverted box-like portion 61 rests on the ledge 28, and may be then ultrasonically welded to the peripheral ledge. A rectangular aperture 62 on the top 61, is open to access handle 39. The inner sidewalls of the box-like portion 61 enclose closely the slider to permit the slider longitudinal motion only, the top of the box-like portion 61 preventing upward movement of the slider 11.

In FIG. 10 there are a plurality of the deformable hold-down tabs 72 and 73 before deformation and before the contacts have been included in their appropriate recesses.

Figure 11:
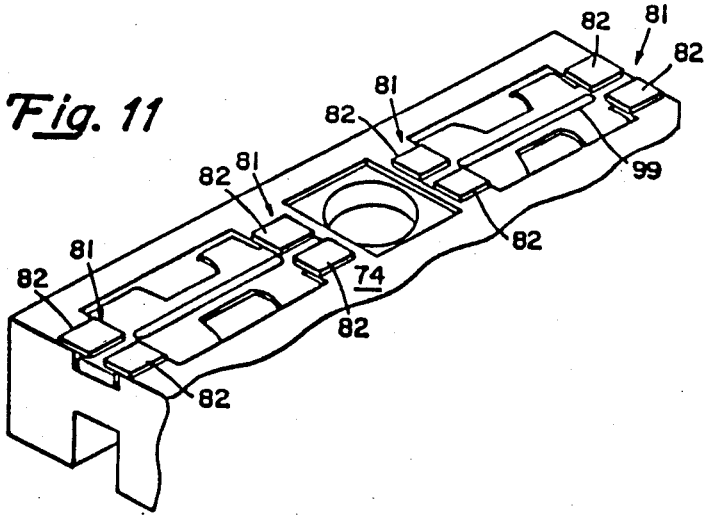
FIG. 11 is an enlarged partial side perspective view showing the support pads.

In FIG. 11 there are numerous pairs 81 of support pads 82 on the surface 74 of the slider which may support the cover.

Figure 12:
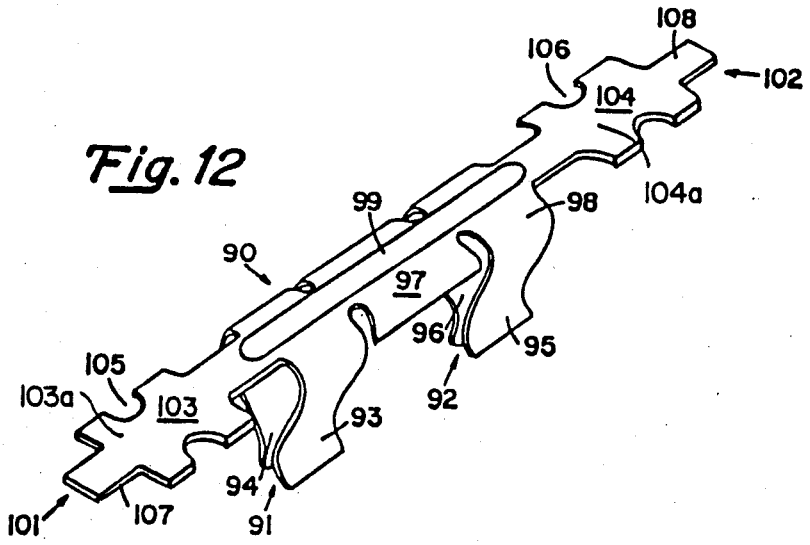
FIG. 12 is an enlarged side perspective view of the inverted U-shaped contact.

FIG. 12 highlights a U-shaped contact 90 which has two pairs 91 and 92 of downwardly extending teeth 93, 94, 95 and 96 (exemplary of teeth 55*a* and 56*a*) which are longitudinally connected to each other by a generally transversely semicircular elongated connector 97.

On the upper surface 98 of the contact 90, is an elongated rib 99 which supports the contact.

At each opposite end 101 and 102 of the contact there are extensions 103 and 104 with generally flat square members 103*a* and 104*a* which have a semicircular recesses 105 and 106 The square members 103*a* and 104*a* seat the contact in the slider with rectangular members 107 and 108 protruding from each square member 103*a* and 104*a*, respectively.

Figure 9:
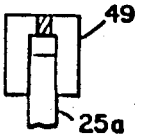
FIG. 9 is a partial sectional view along the lines 9—9 of FIG. 6 with addition of a pin in place.

To assemble the switch the slider 11 is placed on top of the base 10 with the pairs of teeth gripping or engaging the corresponding contact pins, as shown in FIG. 9 with a pin 25*a* grasped. Thus, for example, teeth 55*a* and 55*b* may clasp or engage pin 21*a*. In this position, pin 21*a* is engaged between teeth 55*a* and 55*b*, and pin 22*a* is engaged between teeth 56*a* and 56*b*. In this fashion the teeth of downwardly extending contact 49 clasp the pins 24*a* and 25*a*. In this initial position the teeth of contact 48 engage and short circuit the pins 21*a* and 22*a*, the teeth of contact 49 engage and short circuit the pin 24*a* and 25*a*, the teeth of contact 50 engage and short circuit the pins 24*b* and 25*b*. The top is now put in place and affixed by ultrasonic welding or the like at the ledge 28. When in place, the handle 39 is accessible and the switch slider may be slid to either position. In the other position the teeth of contact 48 engage pins 22*a* and 23*a*, the teeth of contact 49 engage pins 25*a* and 26*a*, the teeth of contact 50 engage the pins 22*b* and 23*b*, and the teeth of contact 51 engage the contact pins 25*b* and 26*b*. As the contact 48, 49, 50 and 51 are each respectively, a single conductor, the effect is to bridge and short-circuit, as noted above, the pins engaged by the teeth of any contact at any time. The initial position, of course, may be that described for the second position of the slider described above. In each of the selected positions a detent action is secured by the cooperation of the base detent and one of the slider recesses, the slider being held down by the cover or top 12.

Briefly, electrically we have a slide switch which either short-circuits contacts 13*a* to 14*a*, 16*a* to 17*a*, 13*b* to 14*b*, and 16*b* to 17*b* in one switch position, or in the other switch position short-circuits contacts 14*a* to 15*a*, 17*a* to 18*a*, 14*b* and 15*b*, and 17*b* to 18*b*.

The description herein uses up and down, top and bottom, solely for ease of description. It will be understood that orientation of the switch is not significant.

The slide switch described has a merit of avoiding any torque in its detent action with respect to a longitudinal vertical plane of symmetry, such torque being inherent in the Fukuda detent which is constructed to act on one side of the slide of the slide switch. Applicant's detent is slight and the complementary or matching recesses in the slider provided herein is sufficient to give the desired detent action. Even though the top bears lightly against the slider, there is sufficient natural resilience of the material to allow the detent action to occur. Moreover, the symmetry and simplicity of the arrangement of the present invention leads to an easy and simple manufacturing process.

What is claimed:

1. An inverted U-shaped contact for use in a dual in-line package slide switch having a base with contact pins arranged in a longitudinally extending row and a slider that is longitudinally slidable with respect to the base including at least one recess for receiving said contact thereby to move said contact relative to the contact pins, said contact having a longitudinal axis and comprising as integral elements thereof:

a generally transversely semicircular elongated connector member having an upper surface and an elongated supported rib on said upper surface, two spaced pairs of teeth depending from said connector member, each tooth of each pair depending from said connector member in a curved shape and each said tooth in a pair having a convex clasping surface facing a like convex clasping surface of the other tooth of the same pair, each tooth in a said pair being supported in a spaced configuration for engaging the contact pins in the base, A generally square, planar member extending along the longitudinal axis from each end of said connector member adjacent the pairs of teeth, each said planar member having at least one recess formed therein, each said recess facing outwardly and transversely of the longitudinal axis for engagement by portions of the slider adjacent the recess therein, said contact being affixed to said slider by deforming portions of the slider adjacent said planar members through said recess and in and about said planar members.

2. An inverted U-shaped contact as described in claim 1 wherein each said recess is semicircular.

* * * * *